United States Patent [19]

Dicks

[11] Patent Number: 4,756,575

[45] Date of Patent: Jul. 12, 1988

[54] FRAME ASSEMBLY FOR A CHAIR

[75] Inventor: Peter Dicks, Cambridge, Canada

[73] Assignee: Faultless-Doerner Manufacturing Inc., Waterloo, Canada

[21] Appl. No.: 47,462

[22] Filed: May 11, 1987

[51] Int. Cl.[4] ..... A47C 3/00

[52] U.S. Cl. ..... 297/305; 297/285; 297/301; 297/304; 297/353

[58] Field of Search ..... 297/301, 304, 305, 285, 297/291, 300, 307, 293, 353

[56] References Cited

U.S. PATENT DOCUMENTS

| | | | |
|---|---|---|---|
| 427,085 | 5/1980 | Hough | 297/305 |
| 3,602,537 | 8/1971 | Kerstholt et al. | 297/304 X |
| 4,232,900 | 11/1980 | Parker | 297/305 |
| 4,533,177 | 8/1985 | Latone | 297/301 |
| 4,640,547 | 2/1987 | Fromme | 297/301 |
| 4,640,548 | 2/1987 | Desanta | 297/301 X |

FOREIGN PATENT DOCUMENTS

| | | | |
|---|---|---|---|
| 50935 | 11/1935 | Denmark | 297/291 |

*Primary Examiner*—James T. McCall

*Attorney, Agent, or Firm*—Fetherstonhaugh & Co.

[57] ABSTRACT

A frame assembly for a chair includes a base member, a seat support member and a backrest member. The front end of the seat support member is pivotally mounted on the front end of the base member a seat suspension spring is provided for the purposes of urging the seat support member to its elevated position. The seat suspension spring is mounted at a point spaced a substantial distance from the pivotal connection between the base and the seat support. Preferably, the suspension spring is a compression spring mounted rearwardly of and extending longitudinally of the backrest member so as to enjoy a substantial mechanical advantage.

5 Claims, 4 Drawing Sheets

FRAME ASSEMBLY FOR A CHAIR

This invention relates to frame assemblies for use in chairs. In particular, this invention relates to a frame assembly for a chiar which has a backrest which is pivotal with respect to the seat of the chair.

PRIOR ART

Springs have long been used to resist the movement of a backrest of a chair from its upright position to its rearwardly inclined position. Torsion springs have been commonly used for this purpose, the torsion spring being located below the seat portion of the chair.

There has been a recent trend in the chair industry to locate the hinge point of the chair support portion of the frame adjacent the front end of the frame as this provides increased seating comfort because the hinge point is located close to the knee joint of the person seated in the chair in use. Customarily, the torsion springs used to spring mount the seat are located on the pivot pin about which the seat support pivots with respect to the base. When the pivot point is located adjacent the front end of the seat support, the moment of the load applied about the pivot point by a person seated on the chair is very high and consequently, a very strong torsion spring is required. Torsion springs and in particular strong torsion springs are expensive to manufacture and are relatively large. In addition, because of the high loads which are applied, these torsion springs are heavily loaded when the chair is in use and a great deal of energy will be released if any of the mounting structures should fail. The uncontrolled release of the energy of a highly loaded torsion spring could result in injury to a person seated on the chair or located in close proximity to the chair when such a failure occurs.

The present invention overcomes the difficulties of the prior art by locating seat suspension spring at a point remote from the seat hinge point.

It is an object of the present invention to locate the seat suspension spring at a point remote from the seat hinge point.

It is a further object of the present invention to employ a compression spring for the purposes of providing seat suspension and to locate the compression spring at a point remote from the hinge point of the seat support.

It is a still further object of the present invention to locate the seat suspension spring in a position extending along the back face of the backrest portion of the frame assembly.

SUMMARY OF INVENTION

According to one aspect of the present invention, there is provided a frame assembly for a chair comprising a base having a front end and a back end, a backrest member having an upper end and a lower end, said backrest member being mounted to pivot relative to the base so that its upper end is movable relative to the base between a first forward position and a second rearwardly inclined position with respect to the base, the backrest member having a back end which is remote from the front end of the base, and a compression spring assembly extending longitudinally of the back end of the backrest, said spring assembly comprising a longitudinally compressible compression spring having an upper end and a lower end, the upper end of the compression spring being retained with respect to the backrest member and the lower end of the compression spring being retained with respect to said base such that the compression spring is compressed in response to movement of the backrest member with respect to the base member from said first position to said second position, said compression spring exerting a restoring force to the backrest urging the back rest toward said first position.

The invention will be more clearly understood after reference to the following detailed specification read in conjunction with the drawings wherein.

Figure 1:
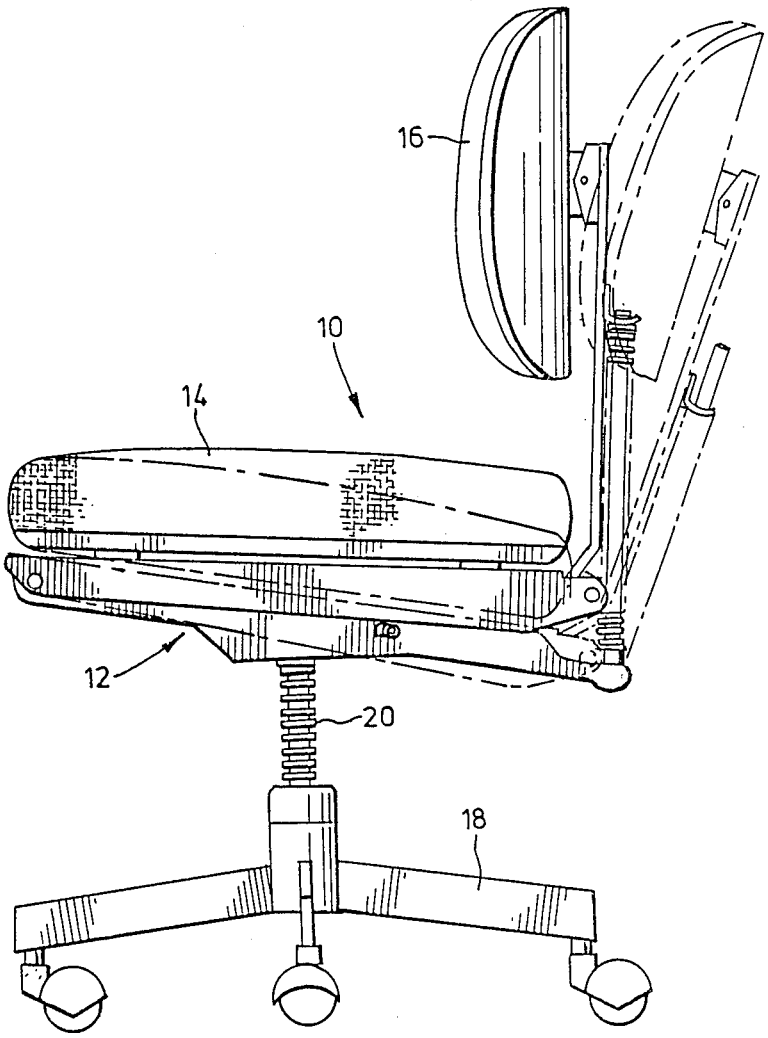
FIG. 1 is side view of a chair incorporating the frame assembly of the present invention.

With reference to FIG. 1 of the drawings, the reference numeral 10 refers generally to a chair incorporating a frame assembly which is generally identified by the reference numeral 12. The chair also includes a seat cushion 14, a backrest 16, a wheeled base 18 and a threaded support column 20.

Figure 2:
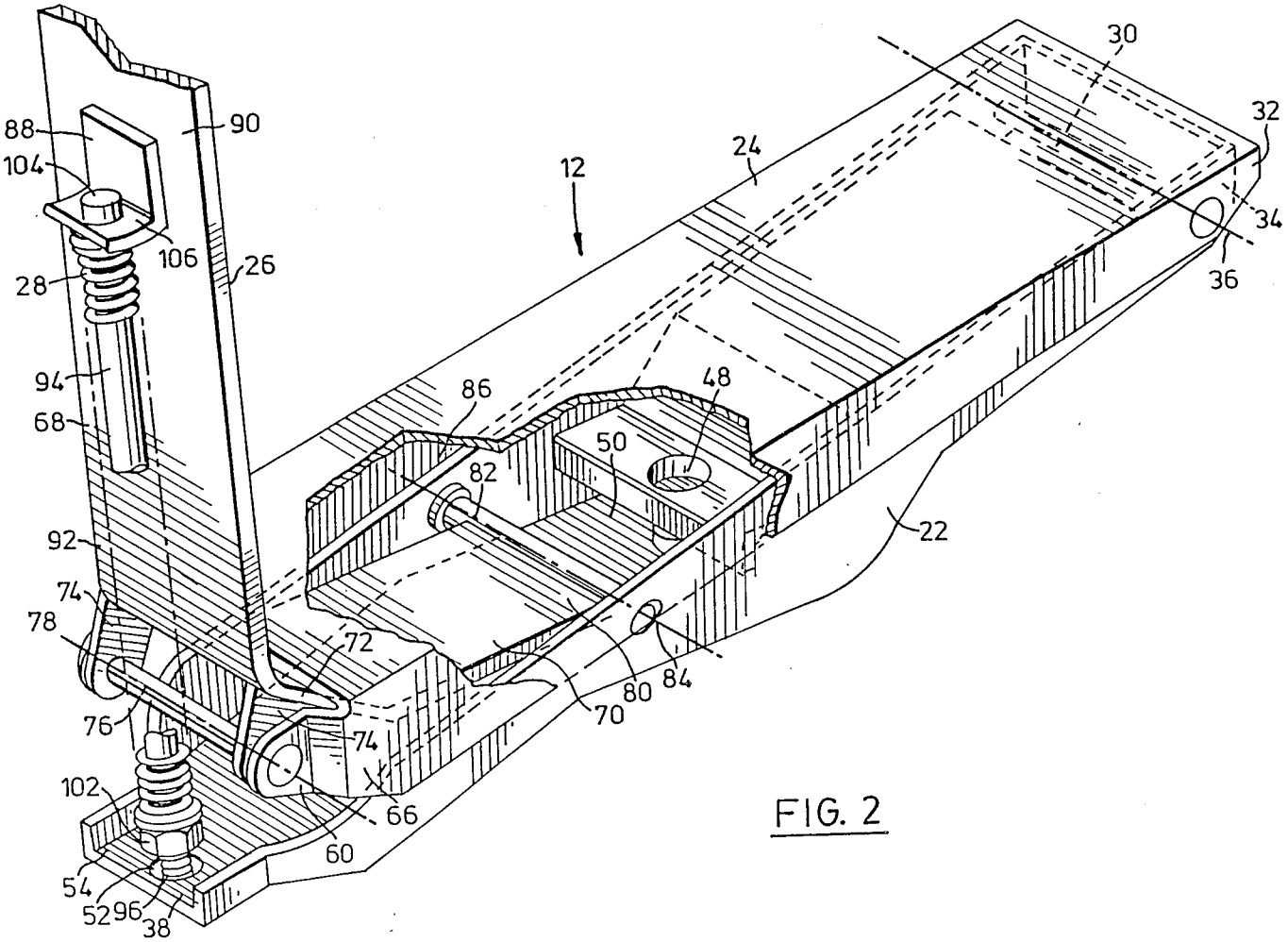
FIG. 2 is a partially sectioned pictorial view of a frame assembly constructed in accordance with an embodiment of the present invention.
Figure 3:
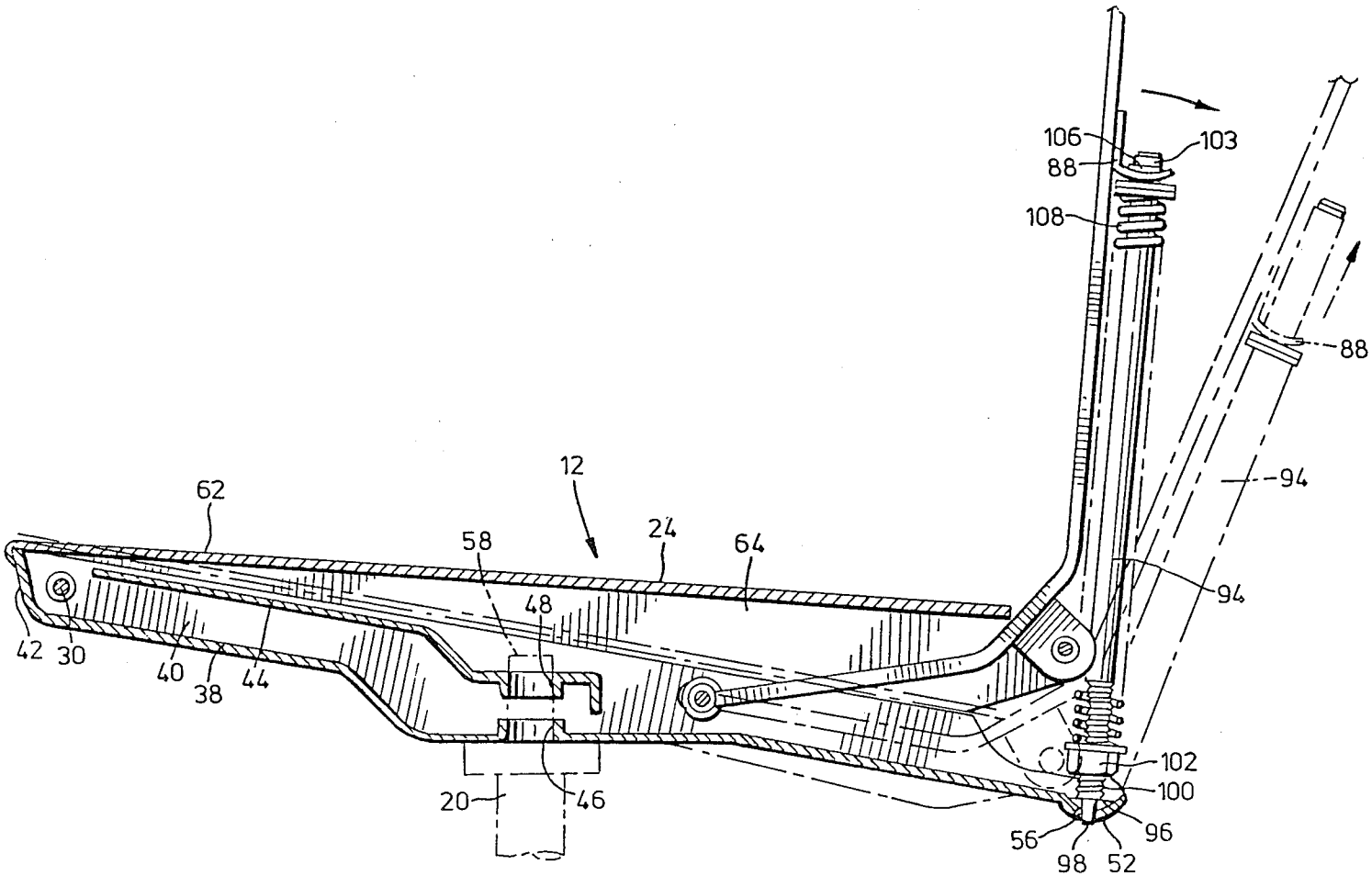
FIG. 3 is a sectional side view of the frame assembly of FIG. 2.

As shown in FIGS. 2 and 3 of the drawings, the frame assembly 12 includes a base member 22, a seat support member 24, a backrest member 26 and seat suspension spring assembly 28.

A pivot pin 30 serves to pivotally connect the front end 32 of the seat support member 24 to the front end 34 of the base member 22 so that the seat support member 20 can pivot with respect to the base member 22 about the axis 36.

As shown in FIG. 3 of the drawings, the base member 22 has a bottom wall 38, a pair of oppositely disposed side walls 40 and a front wall 42. A stiffening plate 44 extends laterally between the side walls 40 in a spaced relationship with respect to the bottom wall 38. Mounting passages 46 and 48 are formed in the bottom wall 38 and a stiffening plate 44 respectively for receiving the upper end 58 of the support column 20.

An upwardly open chamber 50 (FIG. 1) is formed in the base member 22 between the side walls 40 and the bottom wall 38. A concave spring mounting seat 52 is formed in the bottom wall 38 at the back end 54 of the base member 22. A passage 56 (FIG. 3) opens through the bottom of the concave seat 52.

The seat support member 24 has a top wall 62 and a pair of oppositely disposed side walls 64. The side walls 64 are spaced from one another a sufficient distance to extend into an outwardly overlying relationship with respect to the side walls 40 of the base member 22. The side walls 64 are each formed with a lug 60 which projects from the back end 66 of the seat support member 24.

The backrest member 26 is generally L-shaped and includes an upright arm 68 and a generally horizontally extending arm 70. The horizontally extending arm 70 includes an angled corner portion 72. A pair of lugs 74 project rearwardly from the angled portio 72. A pivot pin 76 serves to pivotally connect the lugs 74 to the lugs 76 so as to permit rotational movement of the backrest 26 relative to the seat support 24 about the axis 78.

The distal end 80 of the horizontally extending arm portion 70 is located in the chamber 50 formed in the base member. A shaft 82 is mounted on the distal end 80 and projects laterally into elongated passages 84 formed in the side walls 82 of the base member. Opposite ends of the shaft 82 are slidable in the slots 84 and the shaft 82 is free to pivot in the slots 84 about the axis 86 so as to permit the horizontal arm 70 to rotate with respect to the base member 22 about the axis 86.

A mounting bracket 88 is secured to the back face 90 of the upright arm 68 at a substantial distance above the lower end 92 of the upright arm 26. A washer 96 which has a convex lower surface is seated in the concave seat 52 of the base member 22. A spring mounting post 94 has a lower end portion 98 of reduced diameter projecting through the through passage of the washer 96 and the passage 56. The post 94 has a threaded portion 96 extending upwardly from the portion 98. A load adjusting nut 102 is threadedly mounted on the threaded portion 100. The upper end 103 of the post 94 extends through a passage (not shown) formed in the bracket 88 and has a head portion 104 which rests on a collar 106 which has a lower surface which is formed with a convex curvature corresponding to the concave curvature of the supporting wall of the bracket 88. The collar 106 and head 104 are oversized with respect to the passage formed in the bracket 88 so that they will not pass through this passage.

A compression spring 108 has its upper end arranged to bear against a nylon bush 107 which bears against the bracket 88 and its lower end arranged to bear against the load adjustment nut 102.

When the seat support member 24 is loaded to cause movement from the position shown in solid lines to the position shown in broken lines in FIG. 3, the compression spring 108 will be compressed and the upper end of the post 94 will project beyond the bracket 88. When the load is removed from the seat support member 24, the spring 108 will reassert itself and will return the seat support member to the position shown in solid lines in FIG. 3.

It will be noted that because the compression spring 108 is spaced a greater distance from the axis 36 than the center of mass of the person sitting on the seat cushion in use, the compression spring enjoys a mechanical advantage which contrasts sharply with the conditions prevailing in a conventional support system in which a torsion spring is located coaxially with respect to the axis 36.

In addition, by locating the compression spring 108 in a position extending along the back face of the upright support column, it is remote from the main seating area and will not cause an obstruction to the user. In this location, it can easily be enclosed in a simple casing so that it does not present an unsightly addition to a chair structure.

By locating the compression spring in this convenient location, it is also possible to use a relatively long compression spring and this permits a gradual increase in the resistance to compression resulting from the movement of the backrest between the upright position and the rearwardly inclined position shown in FIG. 3.

In order to adjust the preset load applied by the compression spring 108, it is merely necessary to rotate the load adjusting nut 102.

It has been found that the mechanical advantage resulting from the location of the spring 108 in the position shown in a chair support frame of the type commonly used for secretarial chairs, is of the order of about 2 to 1 with the result that the compressive load applied to the compression spring by a person weighing 100 pounds will be somewhat less than 50 pounds. It will be appreciated that because of this mechanical advantage, the seating comfort will be considerably improved in that the seat will have the feel of being more weight sensitive than that provided when a strong torsion spring is used.

These and other advantages of the present invention will be apparent to those skilled in the art.

Figure 4:
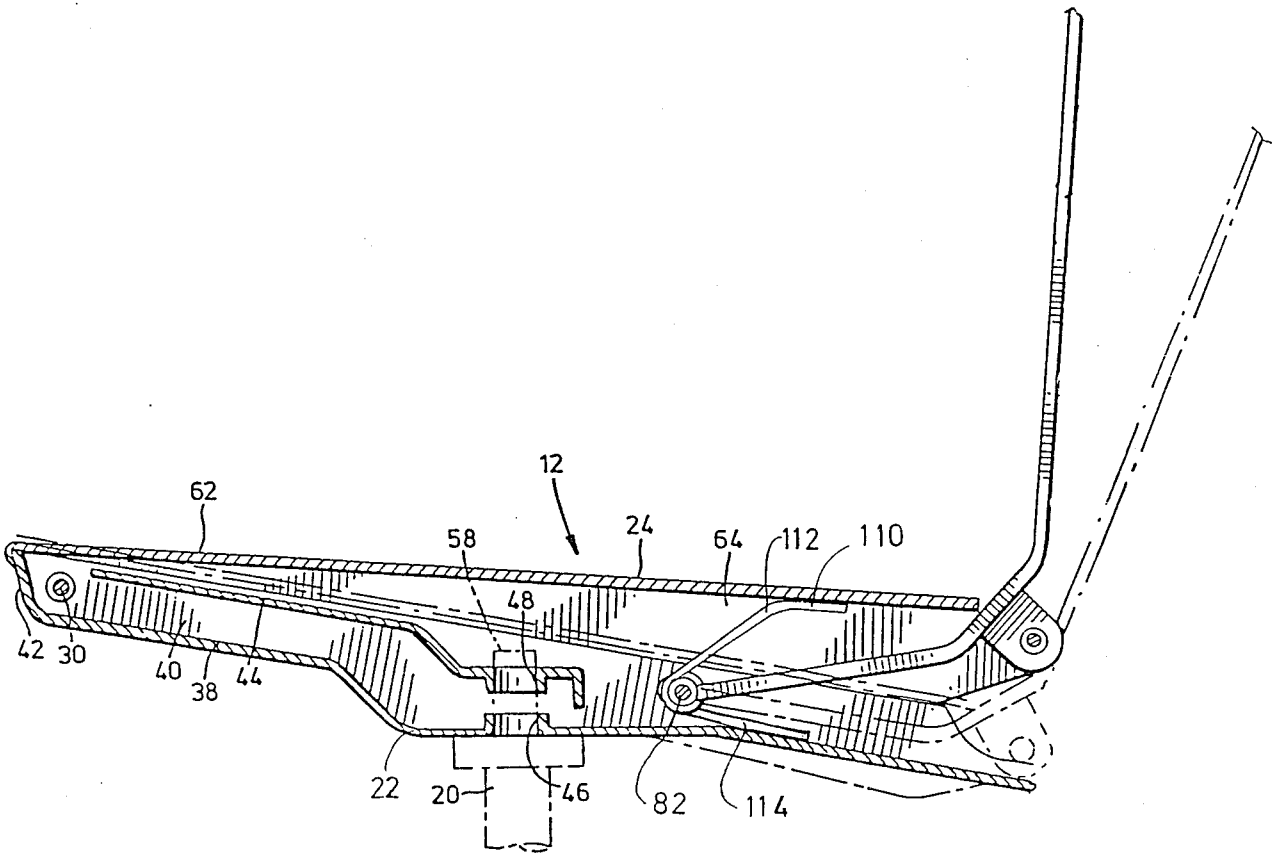
FIG. 4 is a sectional side view similar to FIG. 3 showing a modified structure in which a torsion spring is used to bias the seat support to its raised position.

Various modifications of the preferred embodiment described above will be apparent to those skilled in the art without departing from the scope of the invention. One such modification is illustrated in FIG. 4 of the drawings wherein a torsion spring 110 is used instead of the compression spring 28. The torsion spring 110 is wound around the shaft 82 and has one arm 112 bearing against the seat support member 24 and a second arm 114 bearing against the bottom wall 38 of the base member 22. By reason of the fact that the spring member 110 is spaced a substantial distance from the pivot pin 30, the force applied to the seat member 24 which tends to urge it towards its raised position enjoys a substantial mechanical advantage when attempting to overcome loads applied to the seat support by a person seated on a seat located thereon in use.

Various other modifications of the present invention will be apparent to those skilled in the art without departing from the scope of the invention.

I claim:

1. A self-contained control mechanism for a chair comprising;

(a) a base member having a front end and a back end, (b) a backrest member having a generally upright portion which extends upwardly from the base and has an upper end and a lower end, said backrest member being mounted to pivot relative to the base member so that its upright portion is movable relative to the base member between a first forward position and a second rearwardly inclined position with respect to the base member, the upright portion having a back face which is remote from the front end of the base member, (c) a longitudinally elongated face compression spring assembly located at the back face of the backrest member and having at least a major portion of its longitudinal extent arranged to be coextensive with upright portion of said backrest member to be accommodated in close proximity to the back face of the upright portion of the backrest member, said spring assembly comprising a longitudinally compressible compression spring having an upper end and a lower end, the upper end of the compression spring being retained with respect to the upright portion of the backrest member and the lower end of the compression spring being retained with respect to said base member such that the compression spring is compressed in response to movement of the upright portion of the backrest member with respect to the base member from said first position to said second position, said compression spring exerting a restoring force to the backrest member urging the backrest member toward said first position.

2. A control mechanism as claimed in claim 1, further comprising a seat support member located above the base member, said seat support member having a front end and a back end, said seat support member being pivotally mounted on said base member for movement between a first position in which the back end of the seat member is in its uppermost position and a second position in which the back end of the seat member is in its lowermost position with respect to the base, said backrest member being pivotally mounted on the base member and pivotally mounted on the seat support member such that the seat member is located in its first position when the backrest member is located in its first position and the seat member is located in its second position when the backrest member is located in its second position whereby the compression spring will be compressed when the seat moves from its first position to its second position and the compression spring will apply a restoring force serving to urge the seat to move from its second position to its first position.

3. A control mechanism as claimed in claim 1, wherein the pivotal connection between the seat support member and the base member is located at the front end of the base member and wherein a pivotal connection is provided between the seat support member and the backrest member at the back end of the seat support member.

4. A control mechanism as claimed in claim 2, wherein the backrest member is a generally L-shaped member having an upright arm which forms the upright portion and a horizontal arm, the horizontal arm having an outer end remote from the upright arm, the backrest member being pivotally mounted with respect to the base member at the outer end of the horizontal arm and being pivotally mounted with respect to the seat support member at a point adjacent the intersection of the horizontal and upright arms.

5. A self-contained control mechanism for a chair of the type which has backrest and seat which are free to tilt, comprising;

(a) a base member having a front end, a back end, an upper face and a lower face, mounting means in the base for mounting the base member on a chair support post, said mounting means being accessible at the lower face of the base member and being spaced from the front and back end of the base member, (b) a seat support member having a front end, a back end, an upper face and a lower face, said seat support member overlying the base member, (c) first pivot means pivotally connecting the front end of the seat support member to the front end of the base member, (d) an L-shaped backrest member having an upright arm and a horizontally extending arm, said upright arm having a front face directed toward the front end of the base member and a back face directed in the opposite direction, an upper end and a lower end, the horizontal arm having a proximal end connected to the lower end of the upright arm and a distal end remote from the upright arm, (e) second pivot means hingedly connecting the backrest member to the back end of the seat portion, said second pivot means being located at a point adjacent the intersection of the plane of the upright arm and the plane of the horizontal arm to form a hinge point about which the upright arm may pivot between a first forward position and a second rearwardly inclined position, (f) third pivot means pivotally connecting the distal end of the horizontal arm of the backrest to the base member at a point which is located between the second pivot and the front end of the base member, said third pivot means being slidably mounted with respect to the base to permit limited reciprocating movement of the distal end of the horizontal arm with respect to the base member so as to permit the seat to pivot about the first pivot means and the backrest member to pivot about the second pivot means while the movement of the distal end of the horizontal arm is restrained by the base member, (g) a spring mounting seat at the back end of the base member, (h) spring mounting means on the back face of the upright arm located directly above said spring mounting seat, said spring mounting means being spaced a substantial distance above the lower end of the upright arm, (i) a spring mounting post having a major portion of the length extending in close proximity to the back face of the upright arm and having a lower end supported by the seat to accommodate angular movement of the post and an upper end slidably mounted to telescope in said spring mounting means, the lower end of the spring mounting means being threaded, (j) a spring load adjustment nut threadedly mounted on said threaded lower end of said spring mounting post for movement toward and away from said spring mounting means, (k) a compression spring mounted on said spring mounting post and having a lower end bearing against said load adjusting nut and an upper end bearing against said spring mounting means such that said compression spring resists movement of the upright arm from its first position to its second position and urges the backrest toward its first position.

* * * * *